US006004173A

United States Patent [19]

Schott

[11] Patent Number: 6,004,173

[45] Date of Patent: Dec. 21, 1999

[54] MARINE PROPULSION SYSTEM WITH BYPASS EDUCTOR

[75] Inventor: Carl G. Schott, Fond du Lac, Wis.

[73] Assignee: Brunswick Corporation, Lake Forest, Ill.

[21] Appl. No.: 09/200,617

[22] Filed: Nov. 30, 1998

[51] Int. Cl.[6] ..... B63H 11/00

[52] U.S. Cl. ..... 440/38; 440/47

[58] Field of Search ..... 440/38, 47, 39, 440/1, 2; 60/221, 222

[56] References Cited

U.S. PATENT DOCUMENTS

| | | |
|---|---|---|
| 3,797,447 | 3/1974 | Stubblefield . |
| 3,802,376 | 4/1974 | Smith . |
| 3,943,876 | 3/1976 | Kiekhaefer . |
| 4,004,541 | 1/1977 | Onal . |
| 4,073,257 | 2/1978 | Rodler, Jr. . |
| 4,231,315 | 11/1980 | Tachibana et al. . |
| 4,925,408 | 5/1990 | Webb et al. . |
| 5,123,867 | 6/1992 | Broinowski . |
| 5,421,753 | 6/1995 | Roos . |
| 5,476,401 | 12/1995 | Peterson et al. . |
| 5,536,187 | 7/1996 | Nanami . |
| 5,700,170 | 12/1997 | Mataya . |
| 5,863,229 | 1/1999 | Matte ..... 440/47 |

FOREIGN PATENT DOCUMENTS

| | | |
|---|---|---|
| 0241296 | 10/1986 | Japan ..... 440/47 |

*Primary Examiner*—Ed Swinehart
*Attorney, Agent, or Firm*—William D. Lanyi

[57] ABSTRACT

A jet propulsion system is provided for a water craft in which the secondary flow channel allows water to flow around the impeller region and bypass the impeller blades under certain conditions. The bypass feature provided by the secondary flow channel decreases static inlet pressure and improves the operation of the marine propulsion device at high speeds. In addition, the secondary flow channel increases the total mass flow of water through the steering rudder and therefore improves steering when the propulsion system is being rapidly decelerated, such as during sudden stopping conditions. The secondary flow channel can incorporate one or more individual conduits that bypass the impeller region of the propulsion system or, alternatively, can comprise an annular channel completely surrounding the impeller region.

17 Claims, 8 Drawing Sheets

MARINE PROPULSION SYSTEM WITH BYPASS EDUCTOR

BACKGROUND OF THE INVENTION

1. Field of the Invention

The present invention is generally related to marine propulsion systems that incorporate a jet pump and, more particularly, to a water jet propulsion system that, under certain conditions, incorporates one or more bypass channels that allow water to flow through a secondary channel to avoid passing through the impeller region of a primary flow channel.

2. Description of the Prior Art

Many different types of water jet propulsion systems are known to those skilled in the art. Some are mounted with an inlet opening formed in the hull of a boat. Others are mounted on the driveshaft housing of an outboard motor. All of the known water jet propulsion systems incorporate an inlet passage through which water is received, an impeller region where the water is accelerated by the blades of a rotating impeller, and a discharge region that can incorporate a nozzle. In some applications, the nozzle is moveable about a vertical axis to facilitate steering of a marine vessel incorporating the water jet propulsion system.

U.S. Pat. No. 5,123,867, which issued to Broinowski on Jun. 23, 1992, discloses a jet propulsion unit for a marine craft. A stream of water is induced in a converging inlet section and delivered as a steady laminar shaped flow regime to an impeller section where an impeller/diffuser vane combination and a converging annular volume enables operation of the vessel over a wide range of speeds and sea conditions without cavitation. Acceleration of water energized by the impeller through an interchangeable nozzle provides additional thrust and maneuverability. The propulsion unit additionally incorporates an arm-hole duct in the inlet housing for easy clean-up of any fouling and a bypass valve positioned upstream from the impeller to eliminate balling and drag caused thereby.

U.S. Pat. No. 4,004,541 which issued to Onal on Jan. 25, 1977, describes a pump which is used to propel the boat by means of a jet of water created by the pump. The pump includes a housing which is mounted exterior to the hull. A drive shaft and an impeller are mounted to rotate within the housing. The drive shaft extends through the transom of the boat and may be coupled directly to a gas turbine engine or other power generating device. The impeller is of the double suction type and includes ports for equalizing pressures on either side of the impeller at the suction positions thereof. The housing provides a double volute to receive the effluent from the impeller and direct it aft to a nozzle. Nozzle mechanisms are disclosed which provide easy steering and boat trim control under high thrust loads. A thrust reversal system is employed which directs the jet of water forward for stopping and reversing. A new scoop design is also included which reduces the possibility of air entrapment and loss of suction and increases the ram jet pressure for higher pump efficiency.

U.S. Pat. No. 4,073,257, which issued to Rodler, Jr. on Feb. 14, 1978, discloses a marine propulsion system for boats in which the thrust force center line is below the boat reaction center line to urge the propulsion system thrust line to tilt downwardly. The tilting of the propulsion system line downwardly lifts the stem of the hull to create a suitable vertical vector. As a consequence thereof, the boat is urged into a planing position for the reduction of drag on the boat in the lower speed range. At the higher speeds, dynamic water pressure reacts on the intake to urge the tilting of the thrust force center line upwardly toward a horizontal position to reduce the depth of the bow of the boat submerged in water for reducing the drag on the boat. A tension spring controls the angle of the tilting of the thrust force center line to attain the changeover at a selected speed for optimum operation.

U.S. Pat. No. 4,231,315, which issued to Tachibana et al on Nov. 4, 1980, describes a water jet propulsion unit for a personal watercraft. The propulsion unit is used for vessels which includes a water duct having an inlet and outlet portion and an impeller disposed in the water duct. The outlet portion has a variable outlet nozzle which can discharge water downwardly when desired to produce a lift force for lifting the stem of the vessel. The arrangement provides an improved rolling stability under a stationary condition and is also effective to decrease a drag force under the hump condition.

U.S. Pat. No. 5,700,170, which issued to Mataya on Dec. 23, 1997, discloses a variable diameter jet propulsion unit. An apparatus alters the diameter of the nozzle of a jet boat and thereby allows a user to maximize acceleration, top speed, fuel economy, or other factors. The apparatus allows a user to adjust the nozzle diameter opening, while the boat is moving, by an elastic annular hydraulic bladder that reduces the cross sectional area of a cone formed by a plurality of cone plates. The apparatus is compatible with steering and trim adjustment devices, and is located rearward of them. The apparatus is also compatible with existing jet boats, and provides a bowl adapter that may be attached to the impeller bowl of an existing jet. A steering collar attaches to the bowl adapter by two vertical pins in order to allow rotation to the left and right. Two horizontal pins on the steering collar support a nozzle front lock plate in a manner that allows vertical trim adjustment. The nozzle cone plates are mounted in a hinged manner to the nozzle front lock plate and the nozzle housing support. A spline assembly forces the nozzle cone plates to act in a symmetrical manner, and bridges the gap between adjacent nozzle cone plates when the nozzle is opened. This prevents the bladder from entering the gaps. An elastic block biases the nozzle cone plates radially outwardly, and opens the nozzle when the hydraulic bladder is not engaged.

U.S. Pat. No. 3,797,447, which issued to Stubblefield on Mar. 19, 1974, describes an inboard propulsion system for a boat. The system utilizes a water jet propulsion characterized by a pair of spaced nozzles which are each provided with individually controlled deflecting hoods to enable providing both a reverse thrust for backing the boat and to selectively reverse the water jet in a single nozzle to provide a turning force for steering the boat. Preferably, each of the nozzles is provided with a servo system which varies the effective opening of the nozzle in response to changes in the pressure differential between the intake pressure to the main impeller unit and the discharge pressure to the impeller unit to attempt to maintain a constant quantity flow from the nozzles independent or regardless of any variations in the intake pressure of the impeller unit.

U.S. Pat. No. 4,925,408, which issued to Webb et al on May 15, 1990, describes an intake and pump assembly for an aquatic vehicle. The intake and pump assembly includes an intake housing, a pump body, and a discharge nozzle. The intake housing is provided with an intake grill and flow director. The impeller is surrounded by a wear ring. A vane in integrally formed within the pump body. The drive shaft assembly is provided with couplers and ball guides of resilient material which interconnect the component parts of the drive shaft assembly and absorb shock and misalignment. Stacked washers are provided for adjustment purposes.

U.S. Pat. No. 3,943,876, which issued to Kiekhaefer on Mar. 16, 1976, discloses a water jet boat drive. The water jet is mounted rigidly entirely outboard of the boat and driven from an inboard engine by an interconnecting shaft through the transom. The tail nozzle is mounted concentric of and spaced from the pump chamber of the jet and extends rearwardly therefrom and axially thereof. A butterfly trim vane is pivotally mounted on a transverse horizontal axis in the tail nozzle and is adapted to close the nozzle for blocking the jet and compelling a reverse flow of the water from the pump through passages between the pump chamber and tail nozzle. A steering vane is mounted on a vertical axis rearwardly of the tail nozzle and carries a rudder disposed beneath the jet steering vane for steering during reversal of the jet. The engine exhaust is introduced to the jet stream within the tail nozzle and has a bypass operable during reversing of the jet stream.

U.S. Pat. No. 5,476,401, which issued to Peterson et al on Dec. 19, 1995, describes a compact water jet propulsion system for a marine vehicle. It incorporates an unconventional and compact design which includes a short, steep, hydrodynamically designed inlet duct that is adapted for mounting to the surface of the vehicle hull and extending internally thereof, a water jet pump having an inlet end attached to the outlet end of the inlet duct, a motor for rotating the pump impeller, a drive shaft located completely outside of the flow path connecting the motor with the pump impeller, a flow passage for discharging accelerated flow received from the pump in a generally rearward direction, and a steering and reversing mechanism pivotably mounted about a substantially vertical axis to the aft portion of the vehicle hull for redirect accelerated flow received from the outlet nozzle so as to provide maneuvering capability to the vehicle.

U.S. Pat. No. 5,421,753, which issued to Roos, on Jun. 6, 1995, describes a marine jet drive which has improved operations, especially with regard to having efficient adaptation to propulsion engine and hull design. It has a drive shaft with a flexible coupling at each end, internal to the jet drive. It also has a through-the-nozzle engine exhaust and a simplified combined means of steering and reversing. In incorporates a controllable nozzle aperture and trim control with a combination reverse flow deflector and trim plate. It also comprises a means to disengage the engine from the jet to obtain a true neutral condition. The jet drive has protection from and removal of debris in the water intake duct and generally provides for fewer overhauls, easier serviceability and lighter weight.

U.S. Pat. No. 4,004,541, which issued to Onal on Jan. 25, 1977, discloses a jet boat pump. The centrifugal pump is used for a boat and is used to propel the boat by means of a jet of water created by the pump. The pump includes a housing which is mounted exterior to the hull. A drive shaft and an impeller are mounted to rotate within the housing. The drive shaft extends through the transom of the boat and may be coupled directly to a gas turbine engine or other power generating device. The impeller is of the double suction type and includes ports for equalizing pressure on either side of the impeller at the suction positions thereof. The housing provides a double volute to receive the effluent from the impeller and direct it aft to a nozzle. Nozzle mechanisms are disclosed which provide easy steering and boat trim control under high thrust loads. A thrust reversal system is employed which directs the jet of water forward for stopping and reversing. A scoop design is included which reduces the possibility of air entrapment and loss of suction and increases the ram jet pressure for higher pump efficiency.

U.S. Pat. No. 5,536,187, which issued to Nanami on Jul. 16, 1996, discloses an outboard jet drive for watercraft. It is intended for use with a jet propelled watercraft which has an outboard motor type of jet propulsion unit. The propulsion is disposed in substantial part forwardly of the transom and beneath the undersurface of the hull for improving its pumping efficiency. The jet propulsion unit is driven by a transmission including a drive shaft having a pivotal joint. The jet propulsion unit is pivotal relative to the engine about an axis containing the axis of the universal joint so that the water inlet opining may be swung inwardly through an opening in the undersurface of the hull which is above the water level for clearing foreign objects from the jet propulsion unit water inlet opening.

Most jet propulsion systems known to those skilled in the art exhibit two characteristics which can be disadvantageous under certain conditions. First, they tend to experience high inlet pressures at high boat speeds. The increase in inlet pressure has a deleterious effect on the efficiency of the jet pump at higher speeds. A second characteristic of known jet propulsion systems is that they can lose their ability to steer the marine vessel when the throttle is suddenly reduced. It would therefore be significantly beneficial if a jet propulsion system could be provided in which these two disadvantageous characteristics are significantly reduced or eliminated. In other words, a jet propulsion system which does not exhibit significantly decreased efficiency at high speed and which does not lose steering authority when the throttle is suddenly reduced to idle speed when the boat is moving would represent a significant improvement in the art of marine propulsion systems that incorporate jet drives.

SUMMARY OF THE INVENTION

A preferred embodiment of the present invention provides a marine propulsion system that comprises a primary flow channel having an inlet, an impeller region, and a primary discharge. An impeller is disposed for rotation within the flow channel between the inlet and the primary discharge. A secondary flow channel extends from the inlet to a secondary discharge to provide a fluid path which is parallel to the primary flow channel and which allows water to bypass the impeller region under preselected conditions.

In a particularly preferred embodiment of the present invention, a component is provided to prevent fluid flow through the secondary flow channel when the preselected conditions do not exist. It also further comprises a means for activating and deactivating the preventing means in response to the preselected conditions. The preselected conditions can comprise a pressure magnitude at a preselected position within the primary channel. The preventing means can be a shutter or other device that is capable of closing the secondary flow channel and preventing flow therethrough. The secondary flow channel can be annular in shape and surround the primary flow channel or, alternatively, it can be a conduit that is connected in parallel with the primary flow channel. The marine propulsion system can be a propulsion system for a personal watercraft, a pleasure boat, or any other type of marine vessel. The secondary flow preventing means can be controlled manually by an operator of a marine vessel or automatically.

The primary advantage of the present invention is that the secondary flow channel provides an alternative fluid path that does not require a portion of the fluid to pass through the impeller section. This increases the total flow through the propulsion system by allowing water to pass freely around the impeller section and increase the total flow of water through the propulsion device. It decreases static inlet pressure and improves the efficiency of operation of the marine propulsion system. In addition, when the throttle is rapidly decreased when the vessel is moving rapidly, the secondary flow channel allows an increased flow of water through the propulsion system to improve steering capability as the vessel decreases in boat speed following the rapid decrease in rotational speed of the impeller because of the decrease in throttle.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
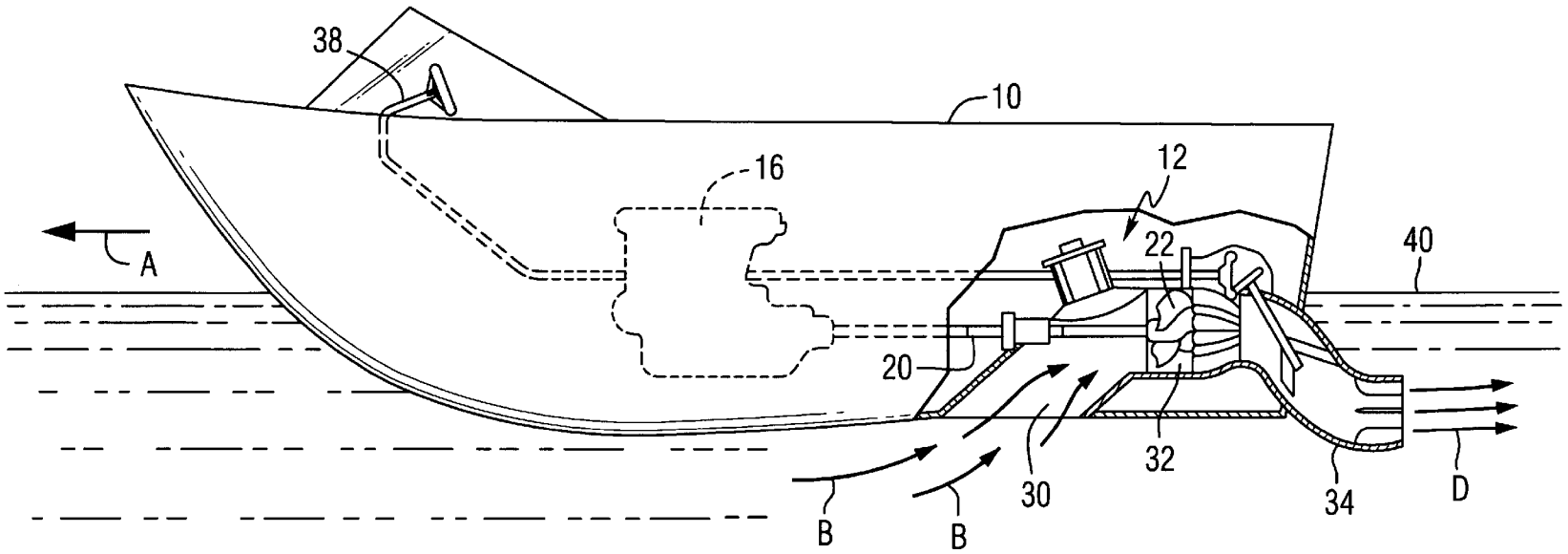
FIG. 1 PRIOR ART
FIG. 1 shows a boat with a jet drive propulsion system.

Throughout the description of the preferred embodiment of the present invention, like components will be identified by like reference numerals.

FIG. 1 shows a known propulsion arrangement in which a boat 10 is provided with a jet propulsion system 12 which is driven by a power source 16, such as an internal combustion engine, which rotates a driveshaft 20 that is connected to an impeller 22. The propulsion system 12 includes an inlet region 30, an impeller region 32 and a discharge region 34 which typically comprises a moveable nozzle that can be used to steer the vessel 10. In the arrangement shown in FIG. 1, a steering mechanism 38 is linked to the nozzle to allow it to be moved about a vertical center line.

In response to rotation to the impeller 22 about its centerline, water is drawn through the inlet 30 and accelerated through the impeller region 32. As the water is discharged in the direction represented by arrows D, forward momentum is imparted on the boat 10. As the boat moves forward relative to the body of water, as represented by arrow A, more water is forced into the inlet 30 as represented by arrows B. Reference numeral 40 represents the surface of the body of water.

Figure 2:
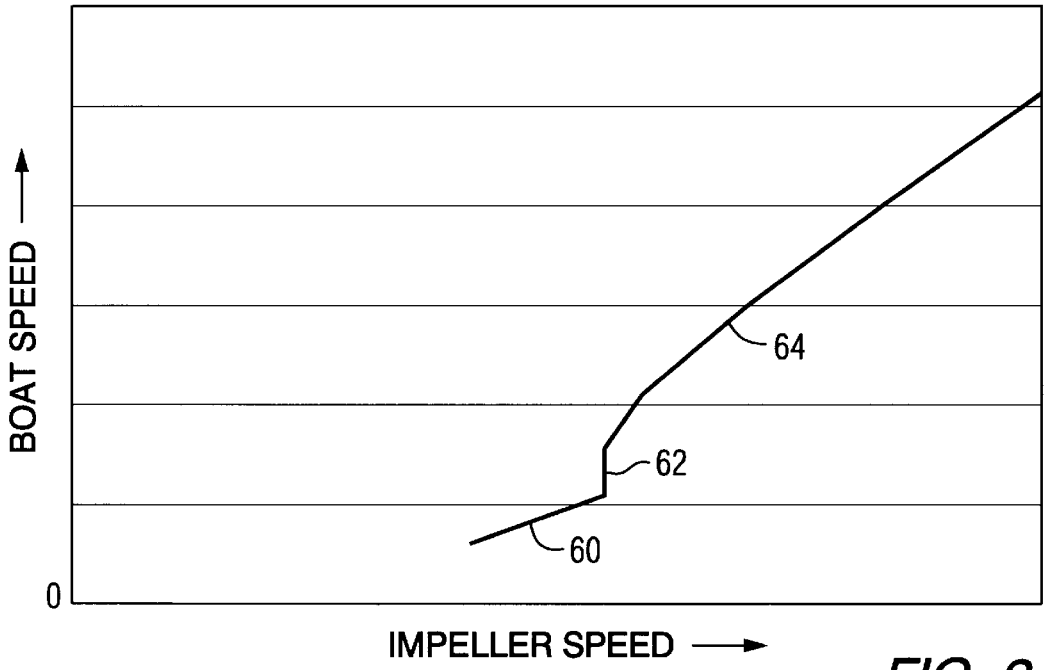
FIG. 2 shows a graphical representation of boat speed as a function of impeller speed.

With reference to FIGS. 1 and 2, those skilled in the art understand the relationship between the rotational speed of the impeller 22 and the speed of the boat 10 relative to the body of water in which it is operated. Although the precise relationship between boat speed and impeller speed varies significantly as a function of hull design and the power of the propulsion system, FIG. 2 represents an exemplary relationship of boat speed as a function of impeller speed. As the impeller increases from standstill condition, the flow of water through the marine propulsion system and its expulsion from the nozzle begins to push the boat 10 through the water. Boat speed is directly proportional to impeller speed at low speeds, as represented by portion 60 of the curve in FIG. 2. At some speed, the boat 10 will rise relative to the surface of the water 40. This is referred to as the planing speed of the vessel. When a boat moves up to a planing position, the amount of hull surface in contact with the water is rapidly and significantly decreased. This, in turn, rapidly decreases the drag on the vessel provided by the hull surface in contact with the water. As a result, boat speed rapidly increases without the necessity of a corresponding increase in impeller speed. This reaction is represented by portion 62 of the curve in FIG. 2. After the boat 10 reaches planing speed, the boat speed continues to increase in a generally direct relationship to impeller speed. This is represented by portion 64 of the curve in FIG. 2.

Figure 3:
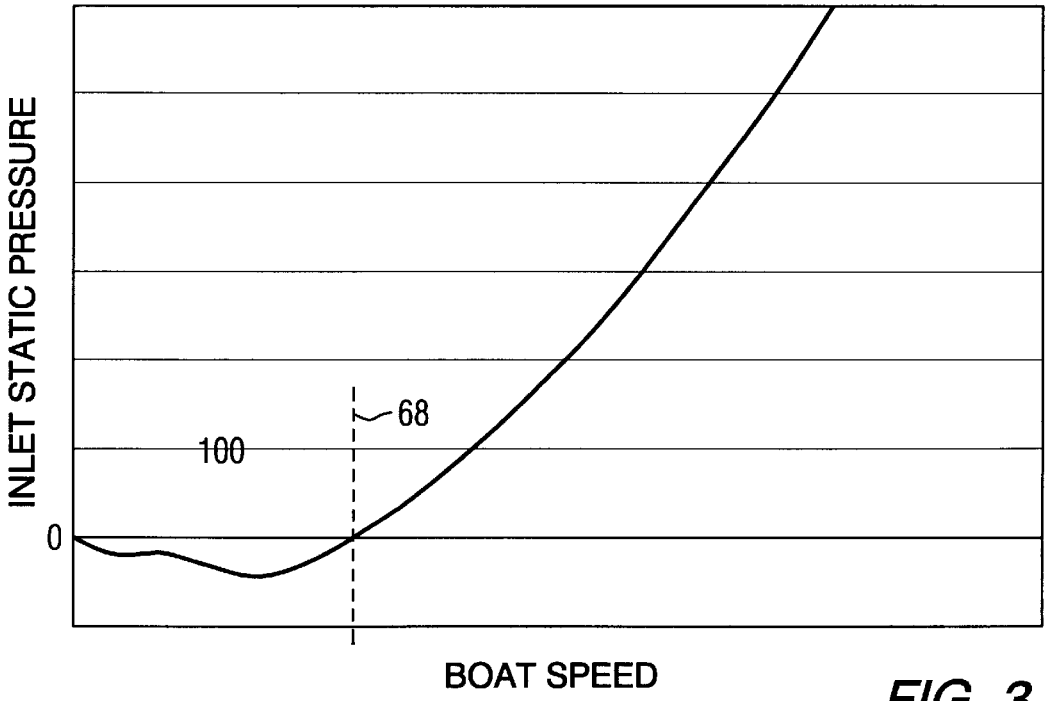
FIG. 3 is a graphical representation of inlet static pressure as a function of boat speed.

With reference to FIGS. 1, 2, and 3, those skilled in the art recognize that increased boat speed causes water to be forced into the inlet 30 of the propulsion system at a significantly increasing rate. Eventually, the forcing of water into the inlet 30, as represented by arrows B, raises the static inlet pressure in front of the impeller 22. This is caused by the intake of water into the inlet 30 at a rate which exceeds the ability of the impeller 22 to accelerate it through the impeller region 32. It should be understood that the water is diffused and experiences a deceleration as it passes from the entrance of the inlet 30 to the impeller region 32. This diffusion increases the inlet pressure as a function of boat speed after the boat 10 has reached a predetermined threshold speed. With reference to FIG. 3, it can be seen that during an initial start-up of a marine propulsion system 12, the inlet static pressure drops below atmospheric pressure as the boat is operated at low speed. This is represented by the portion of the curve in FIG. 3 toward the left of dashed line 68. This reduction in inlet pressure below atmospheric pressure is caused by the impeller 22 drawing water from the inlet 30 at a velocity greater than the boat's velocity. The flow of water into the inlet 30 as represented by arrows B. As the boat 10 increases in velocity relative to the body of water, the movement of the boat forces water into the inlet 30. Eventually, the velocity of water forced into the inlet 30 equals the boat's forward velocity. This velocity is identified by dashed lines 68 in FIG. 3. Beyond that magnitude of boat speed represented by dashed line 68, the velocity of water drawn through the impeller 22 is lower than the boat's forward velocity, and the water must decelerate or diffuse as it passes through the inlet 30. This causes the inlet static pressure to rise above atmospheric as represented by the graph in FIG. 3 in the right of dashed line 68.

Since the water forced into the inlet 30 does not pass easily through the impeller 22 at increased boat speeds, the pressure at the inlet rises and the flow conditions in front of the impeller 22 can become significantly turbulent. This causes the efficiency of the marine propulsion system 12 to decrease at high speeds.

With reference to FIGS. 2 and 3, it should be understood that the graphical representations are exemplary and are not intended to precisely represent any particular vessel or marine propulsion system. However, FIG. 2 generally illustrates how boat speed is related to impeller speed as a marine vessel moves from a standstill condition to and beyond its planing speed. FIG. 3 illustrates how the static pressure of the inlet 30 of a marine propulsion system 12 initially decreases below atmospheric pressure because of the rate at which water is drawn from the inlet 30 through the impeller region 32 to accelerate a boat 10 from the standstill position and then increases beyond atmospheric pressure as a result of water being forced to enter the inlet 30 at a velocity greater than the velocity of water moving through the impeller region 32.

The result represented in FIGS. 2 and 3 show how the efficiency of a jet propulsion system can be adversely affected by the increase in boat speed, particularly when the boat is on plane. It would therefore be significantly beneficial if a jet propulsion system could be developed which avoids the decrease in efficiency of the marine propulsion system at increased boat speeds.

Figure 4:
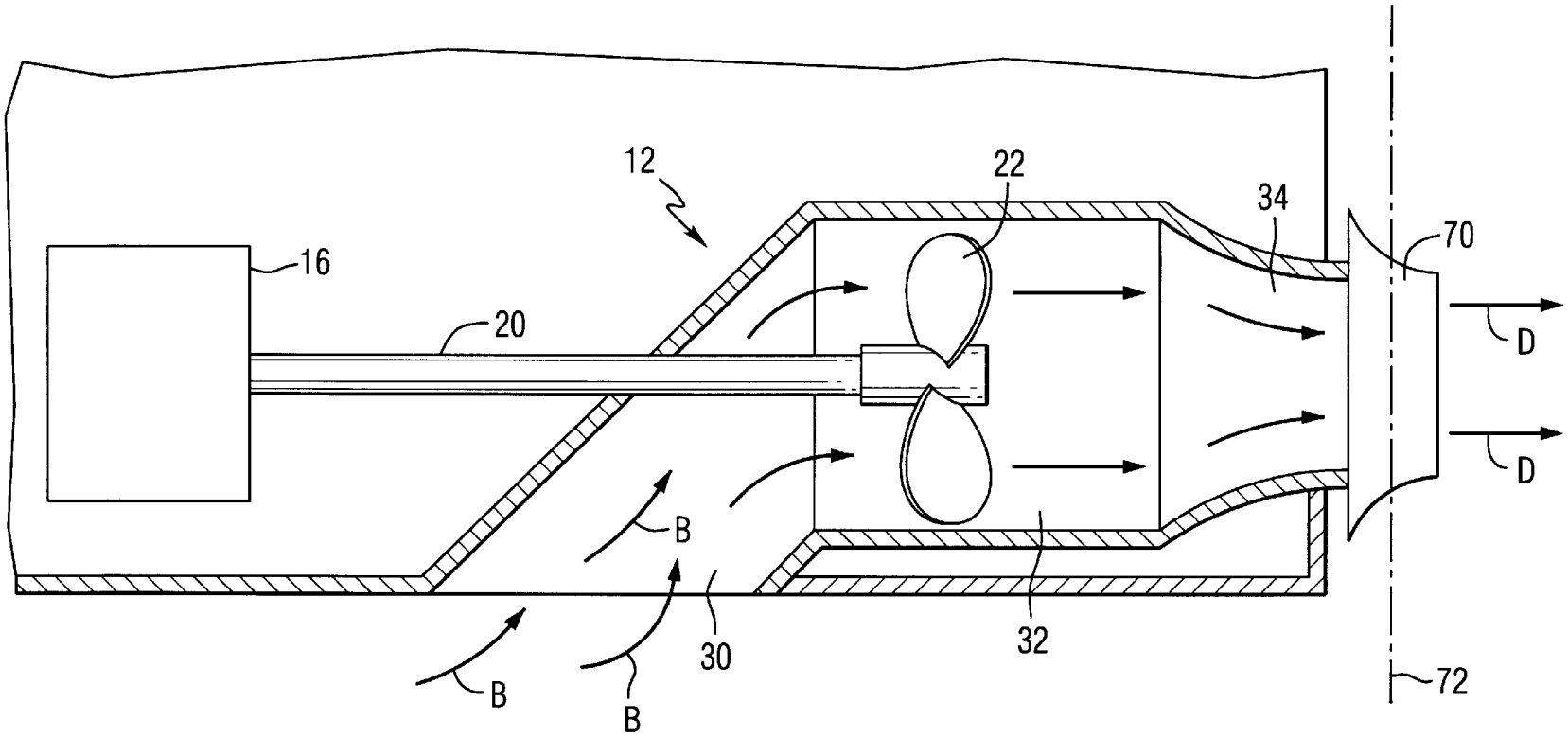
FIG. 4 is a highly simplified schematic representation of a marine propulsion system using a jet pump.

FIG. 4 is a highly simplified schematic representation of a jet propulsion system such as that described above in conjunction with FIG. 1. FIG. 4 is provided for the purpose of showing the conventional structure of a jet propulsion system. Later Figures will be used to show how the system in FIG. 4 is modified in accordance with the present invention. As described above in conjunction with FIG. 1, a power source 16 is provided to rotate a driveshaft 20 that, in turn, rotates an impeller 22. As the impeller 22 rotates, it draws water into the inlet 30 as represented by arrows B. This water is accelerated by the impeller as it passes through the impeller region 32 and the accelerated mass of water is discharged from the discharge region 34, as represented by arrows D. The mass of water discharged by the system creates a reactionary force which propels the vessel in which the marine propulsion system 12 is located.

With continued reference to FIG. 4, a steering rudder 70 is illustrated in conjunction with the discharge 34. The steering rudder 70, in a typical application known to those skilled in the art is rotatable about a vertical axis 72 to direct the discharge stream D in a preferred direction. Many types of marine propulsion systems which incorporate jet drives are steered in this manner. It should be noted, however, that steering by this technique requires a flow of water from the discharge as represented by arrows D. If this flow of water is suddenly decreased, steering ability is significantly affected.

Figure 5:
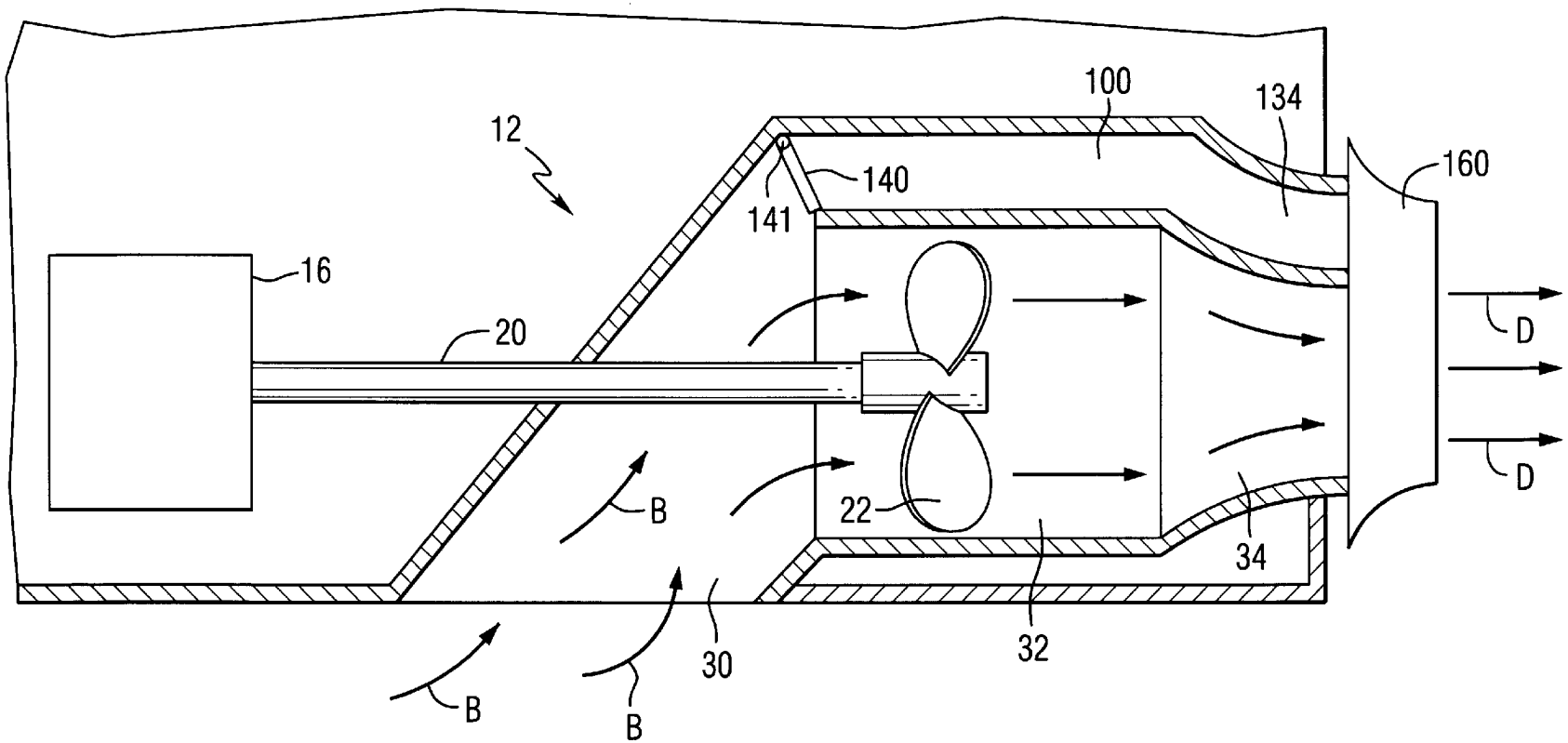
FIGS. 5 and 6 show one embodiment of the present invention.

FIG. 5 shows one embodiment of the present invention. In the terminology that will be used to describe the present invention, the primary flow channel comprises the inlet 30, the impeller region 32, and the primary discharge 34. The embodiment of the present invention shown in FIG. 5 comprises a secondary flow channel 1 00 which can allow a secondary flow of water around the impeller region 32. The secondary flow channel 100 extends from the inlet 30 to a secondary discharge 134 and provides a parallel fluid path to the primary flow channel. The secondary flow channel allows water to bypass the impeller region 32 under preselected conditions. As shown in FIG. 5, a gate 140 is closed and prevents the flow of water from the inlet 30 through the secondary flow channel 100. When the gate 140 is closed, all water entering the inlet 30 must pass through the impeller region 32.

Figure 6:
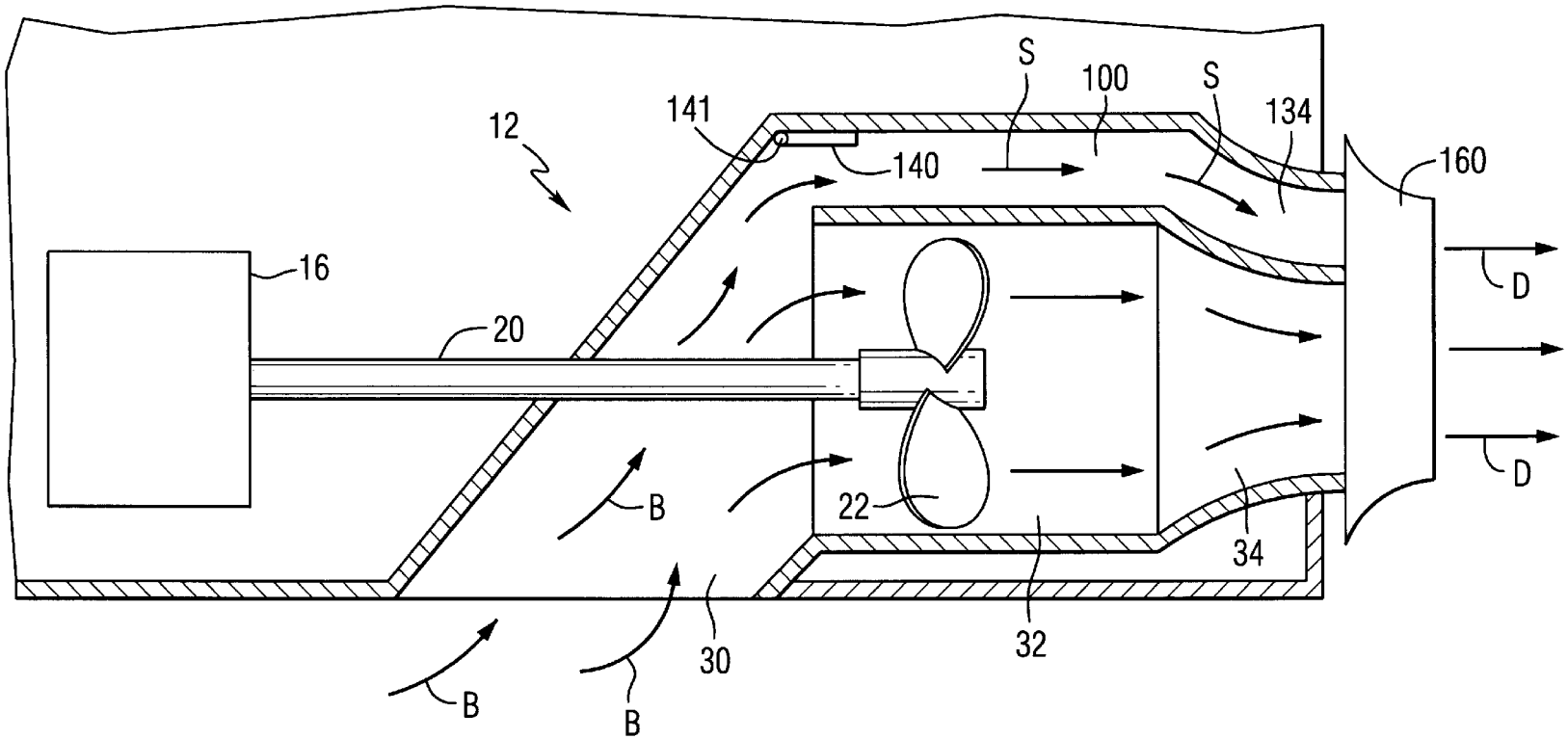

FIG. 6 shows the embodiment of FIG. 5, but with the gate 140 opened to allow flow from the inlet 30 through the secondary flow channel 100. The embodiment shown in FIG. 6 incorporates a simple gate 140 that is pivotable about point 141 to open the secondary flow channel. The secondary flow of water S bypasses the impeller region 32 and flows from the inlet 30 to the secondary discharge 134 without passing through either the impeller region 32 or the primary discharge 34. The primary and secondary flows then join at an enductor 160.

With continued reference to FIGS. 5 and 6, it can be seen that when an increased flow B of water enters the inlet 30 at a rate which exceeds the rate at which the impeller 22 can accelerate the water through the primary discharge 34, the gate 140 can be opened to allow the excess flow of water into the inlet 30 to pass through the secondary flow channel 100. This effect decreases the static inlet pressure forward of the impeller region 32 and alleviates the condition that could otherwise decrease the efficiency of the propulsion system. Furthermore, the discharge flow D is increased by the addition of the flow through the secondary flow channel 100 and is greater than it would have been without the provision of the secondary flow channel. This increased discharge flow, even when the impeller 22 is rapidly decelerating because of a decreased in throttle, such as in a sudden stopping condition, will significantly assist in steering the marine vessel because of the increased mass of water flowing through the steering rudder 70 (not shown in FIG. 6). As a result, steering capability will be enhanced even during sudden throttle down conditions.

Figure 7:
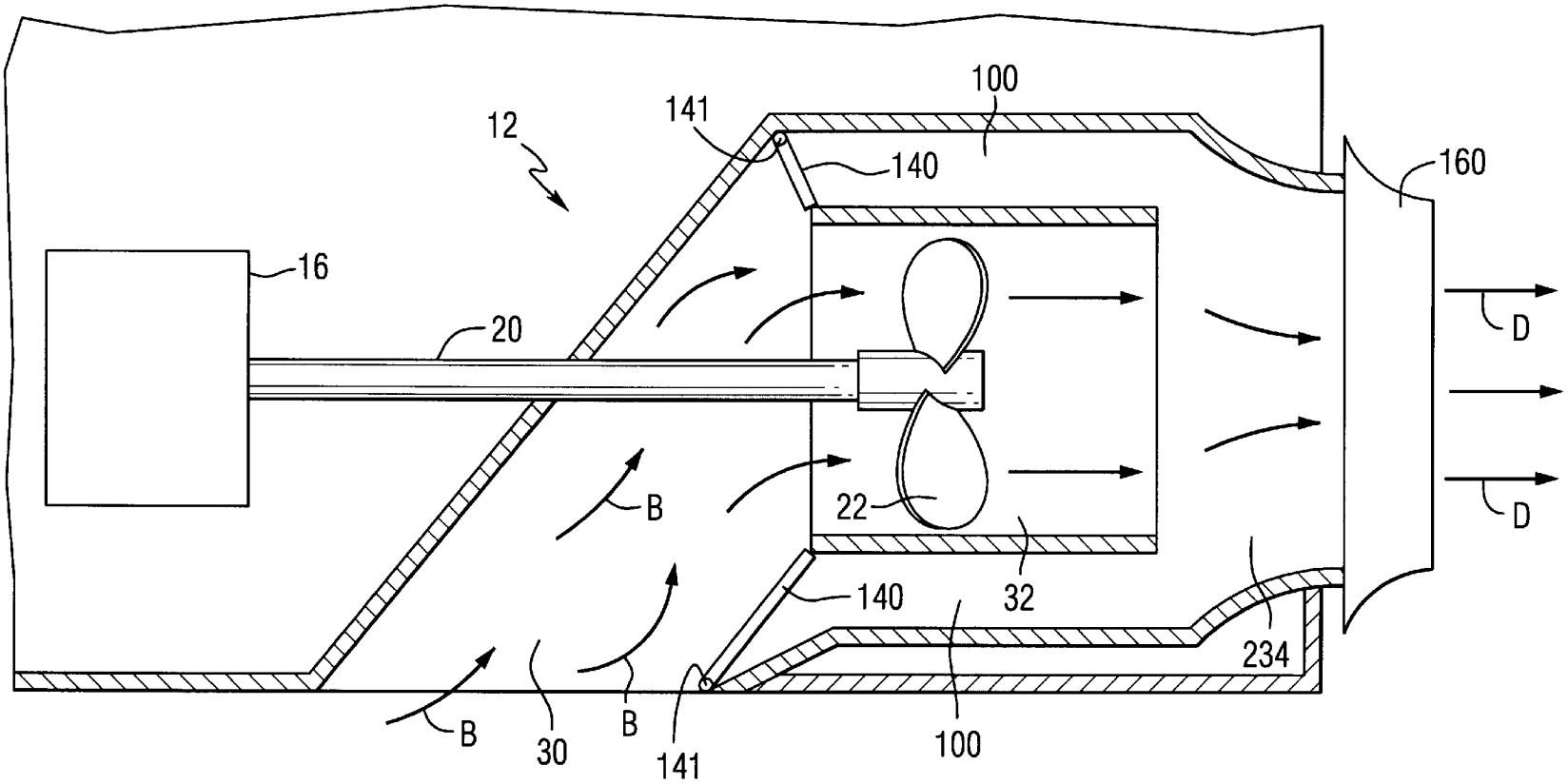
FIGS. 7 and 8 show an alternative embodiment of the present invention.

FIG. 7 shows an alternative preferred embodiment of the present invention in which the secondary flow channel 100 is an annular passageway that surrounds the impeller region 32. In other words, the secondary flow channel surrounds the primary flow channel in the region between the inlet 30 and the discharge. In FIG. 7, the combined discharge 234 is the region of the propulsion system in which the primary and secondary flows are combined aft of the impeller region 32. The gate 140 is provided as a means for preventing fluid flow through the secondary flow channel 100 under certain conditions. For example, as the propulsion system begins to accelerate a boat from a standstill position, it is beneficial to close the gate 140 so that all of the fluid entering the inlet 130 is accelerated by the impeller 22 to flow through the discharge 234 as represented by arrows D. As described above in conjunction with FIG. 3, the inlet pressure is typically less than atmospheric pressure during the period of time when the boat is accelerated from a standstill position to some initial boat speed. When the inlet pressure is less than atmospheric pressure, there is no need to open gate 140. In fact, under certain conditions it might be disadvantageous to open gate 140 during initial acceleration of the boat.

Comparing FIGS. 5 and 7, it can be seen that in FIG. 5 the secondary flow channel 100 comprises a single conduit that extends parallel to the primary flow channel. It can be a simple type of hose configuration that allows a certain amount of water to bypass the impeller region 32. The embodiment shown in FIG. 7, on the other hand, comprises a secondary flow channel 100 that is generally annular in shape and surrounds the impeller region 32. Although not shown in FIG. 7, it should be understood that the impeller region 32 would typically be supported by a series of struts extending radially through the secondary flow channel 100 to support the impeller region housing in a central portion of the propulsion system.

Figure 8:
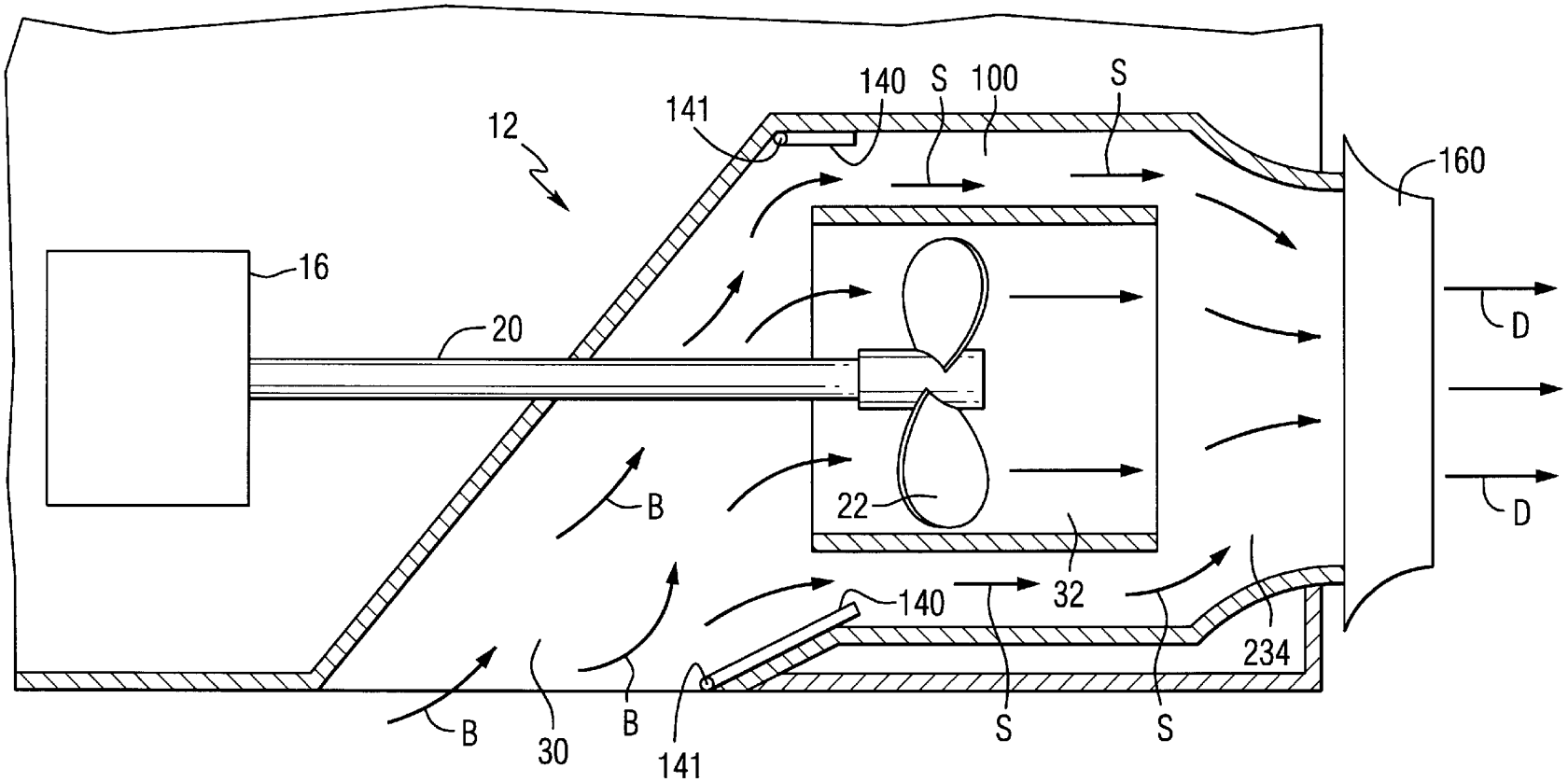

FIG. 8 shows an embodiment of the present invention similar to the one shown in FIG. 7, but with the gate 140 opened. The gate 140, when in the position shown in FIG. 8, allows the secondary flow S to pass through the secondary flow channel 100 and bypass the impeller region 32. The combined discharge 234 includes the water that is discharged by both the primary and secondary flow channels. This increased mass of water D allows the vessel to be steered even during rapid deceleration of the impeller 22 as long as the vessel is moving at a sufficient velocity relative to the body of water. In addition, during acceleration of the vessel, static pressure at the inlet 30 forward of the impeller region 32 can be significantly decreased when the gate 140 is opened. It should also be understood that the flow of water accelerated by the impeller 22 will assist in drawing the secondary flow through the secondary flow channel 100 by eduction since their flows are combined at the eductor 160.

Figure 9A:
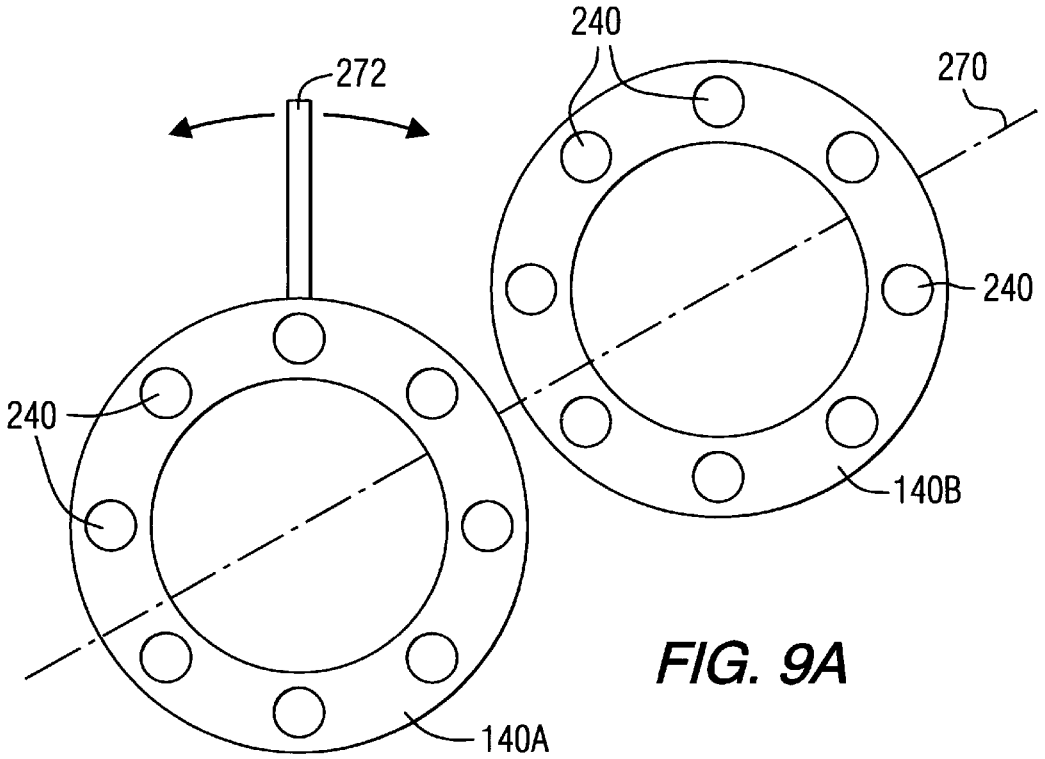
FIGS. 9A and 9B show two shutter configurations that can be used as gates in conjunction with the present invention.
Figure 9B:
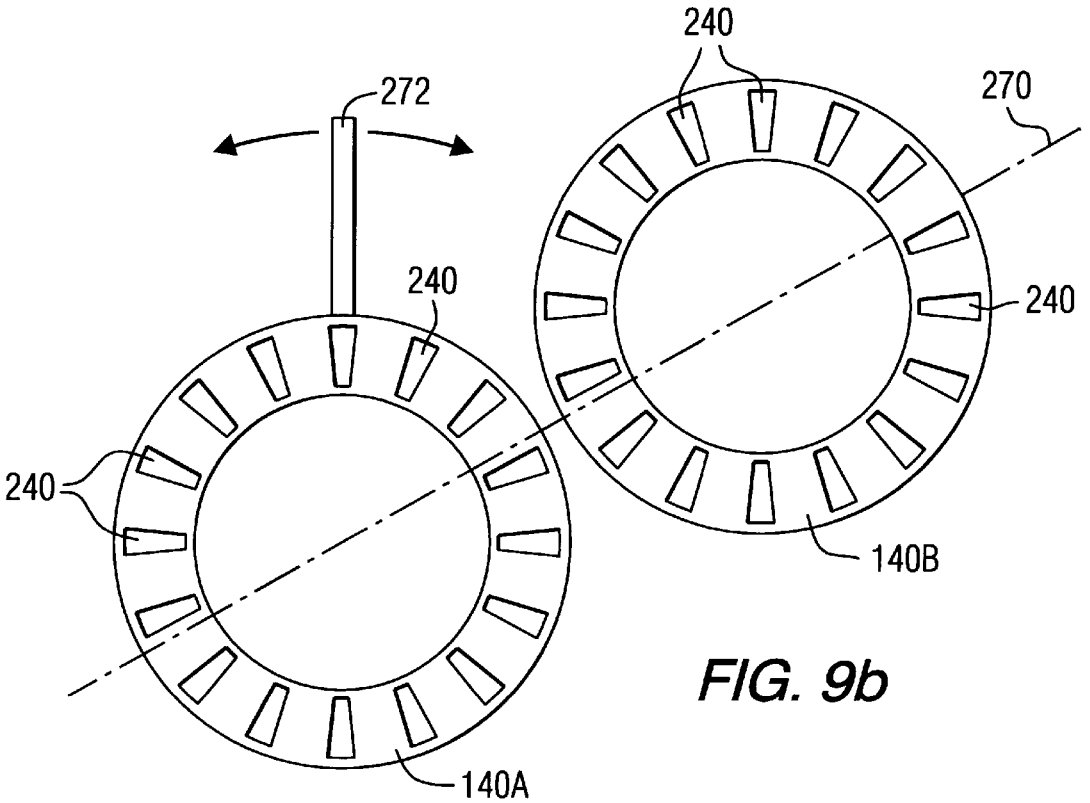

FIGS. 9A and 9B show two possible embodiments of a gate structure. Although shown spaced apart in FIGS. 9A and 9*b*, it should be understood that the moveable shutter 140A and stationary 140B are placed in close proximity to each other to limit the flow through the gate to the water that passes through the openings 240 in both gates. The moveable gate 140A can be pivoted about centerline 270 by manipulation of a pivot arm 272 in the directions represented by the arrows in FIG. 9A. When the holes 240 are aligned in both gates, the flow of water through the secondary flow channel 100 described above is maximized. When the holes 240 in the moveable and stationary gates are in complete misalignment, the flow of water through the secondary flow channel is minimized. The configuration shown in FIG. 9A shows one possible configuration of a shutter system that can be used to regulate flow through the annular secondary flow channel 100 shown in FIGS. 7 and 8.

FIG. 9B shows an alternative embodiment to the moveable and stationary gates, 140A and 140B, described above in conjunction with FIG. 9A. The holes 240 are shaped differently than those shown in FIG. 9A and there are more holes 240 in FIG. 9B than described above. The operation of the gate in FIG. 9B is generally similar in that a pivot arm 272 is used to rotate the moveable gate 140A with respect to the stationary gate 140B to regulate the flow of water through holes 240. In addition to the embodiment shown in FIGS. 9A and 9B, it should also be understood that many different types of gates 140 can be used in conjunction with the present invention. For example, a shutter can be configured similar to an iris shutter of a camera system. Furthermore, an air filled bladder can be used to force a gate open and closed in response to a flow of air into or out of the bladder. In addition, the opening and closing of the gate 140 can be manually controlled or automatically controlled as a function of the inlet pressure forward of the impeller 22. In all embodiments of the present invention, the secondary flow channel is provided to bypass the impeller under certain predetermined conditions. The bypass flow connects the inlet of the marine propulsion system with a discharge to provide a total flow through the system which is greater than the flow of water through the impeller region.

In summary of the above description, it is generally known to those skilled in the art that typical water jet propulsion systems have poor off-throttle steerings and reduced high speed efficiency. Both of these problems are generally related to the difficulty in passing a sufficient quantity of water through the propulser under either high speed or rapid deceleration conditions. With reference to FIGS. 1 and 4–8 described above, a typical waterjet propulsion system in a planing craft consists of a short inlet 30 which is intended to lift water from the bottom portion of the hull of a watercraft 10 to a pump housed within an impeller region 32 above the keel. A single stage pump, comprising an impeller 22, and a nozzle are used to regulate the flow through the pump and optimize its provision of thrust. Steering is typically accomplished by attaching a short turnable tube, or steering rudder 70, downstream of the discharge to develop a vector that is perpendicular to the direction of travel of the boat. This is accomplished by deflecting the pump discharge flow D toward the left or right. When compared to open propeller propulsion systems, water jets typically suffer two significant performance disadvantages. First, they are significantly less efficient in operation at high speed. Secondly, they tend to experience diminished steering authority when the throttle is cut back to idle speed when the boat is moving. This occurs because insufficient water moves through the pump to allow steering forces to be developed by the rudder tube 70. Both of these problems are directly related to the amount of water flow moving the propulsion system and being discharged through the steering rudder. A significant portion of the efficiency is traceable to the inlet 30 which, because of a planing craft's drag characteristics is forced to act as a diffuser when the planing craft is operated at a high speed. Water entering the inlet 30 is rapidly decreased in speed, as much as 60% in some cases, as it approaches the impeller 22. This causes a large rise in static pressure at the inlet 30 and high energy losses because of flow separation. This condition is largely attributable to the pump's inability to process the water at the same velocity as the boat's motion is forcing water into the inlet 30 when operated at high speed. The off throttle steering problem is also largely attributable to the lack of water flow through the impeller region 32 at low impeller speeds. This occurs even when substantial inlet pressure is available to attempt to force the water through the pump when the impeller 22 is not rotating at a sufficient speed. This condition is caused by the relatively high resistance to water flow presented by the impeller's blades. It is often necessary, because of cavitation problems, to provide significant surface area on all of the impeller's blades, but this increased surface area greatly reduces the amount of flow that can pass through the impeller region 32 when the drive shaft speed is suddenly reduced, such as in a sudden stopping condition when the boat is operated at high speed.

In the past, inlet efficiency problems have generally been addressed by adding various types of turning vanes to the inlet 30 in an attempt to reduce losses associated with flow separation. These are usually of limited effectiveness because the surface area of the impeller vanes tends to add more frictional losses and because the overall diffusion that must be provided by most inlets at speeds over 50 mph is much too high for vanes to provide appreciable benefit. Various methods have been proposed to deal with the off throttle steering problem. These include one way clutches which allow the impeller to free wheel in a manner independent of the engine when the engine speed is rapidly reduced. In addition, various forms of throttle kickers or idle speed increasers have been proposed to hold idle speed above a minimum magnitude until the boat speed has been significantly been reduced or whenever a demand for steering is detected by a control system. The present invention addresses both of these problems by providing an alternative path for the water to flow around the pump from the inlet to the nozzle.

As described above in conjunction with the drawings, the present invention addresses both of the problems with jet propulsion systems by providing a bypass channel to allow a secondary flow of fluid around the impeller region 32 from the inlet 30 to the discharge 34. The secondary flow channel can be a single tube or conduit at one or more locations circumferentially disposed around the impeller region 32 or it can be an annular channel completely surrounding the entire impeller region 32. Shutters, doors, or gates 140 can be used to close the secondary flow channel under certain conditions to prevent air from being ingested by the impeller 22 when the marine vessel is moving too slowly to provide sufficient inlet static pressure to pump water through the secondary flow channel. These flow prevention means can take the form of sliding or rotating cylinders, hinged pressure activated doors, or any other structure that is sufficient to close and open the secondary flow channels.

Certain embodiments of the present invention can operate as an eductor propulsor. It is operated essentially as a ducted propeller with a stator housing inside the housing of the propulsion system with an annular channel extending completely around the impeller region 32. Struts, such as radial arms, can be used to connect the duct to the outer housing in order to support the inner housing of the impeller region 32.

When static inlet pressure increases, as can occur at high speed or when the throttle is cut to idle speed as the boat is moving, water is forced through the secondary flow channel from the inlet 30 to the discharge 134 where it is mixed with the jet flow discharged from the impeller region 32. The nozzle should be designed to efficiently mix these two flows. This type of fluid handling system is generally referred to as an eductor and is used in certain pumping devices known to those skilled in the art. Efficient mixing of the primary and secondary flows at high speeds can yield an efficiency increase through two mechanisms. First, the mean jet velocity is reduced and this reduces the jet energy losses as the water jet essentially behaves more like a higher mass flow pump. Secondly, static pressure is reduced at the forward portion of the impeller region and this reduces diffusion losses at the inlet. Off throttle steering is improved because a secondary flow path is provided around the high resistance, or blockage, region of the impeller and this secondary flow path increases the total flow of water to the steering rudder even when the impeller is rotating very slowly or is essentially stationary.

Although the present invention has been described with particular specificity to illustrate several preferred embodiments, it should be understood that alternative embodiments are also within its scope. For example, the various types of gates that can be used in conjunction with the secondary flow channel are not limited to the several which are described above. In addition, the precise structure of the secondary flow channel can take forms other than the single conduit described in FIGS. 5 and 6 or the annular conduit described in FIGS. 7 and 8. The region of the propulsion device where the primary and secondary flows are recombined at the discharge can take forms other than those schematically illustrated and described above. Many other embodiments of the present invention are within its scope.

I claim:

1. A marine propulsion system, comprising:

a primary flow channel having an inlet, an impeller region, and a primary discharge;

an impeller disposed for rotation within said primary flow channel between said inlet and said primary discharge; and a secondary flow channel extending from said inlet to a secondary discharge to provide a parallel fluid path to said primary flow channel which allows water to bypass said impeller region under preselected conditions, said primary and secondary discharges being disposed within a common flow channel.

2. The system of claim 1, further comprising:

a gate for preventing fluid flow through said secondary flow channel when said preselected conditions do not exist.

3. The system of claim 2, further comprising:

means for activating and deactivating said gate in response to said preselected conditions.

4. The system of claim 1, wherein:

said preselected conditions comprise a pressure magnitude at a preselected position within said primary channel.

5. The system of claim 2, wherein:

said gate is a shutter.

6. The system of claim 1, wherein:

said secondary flow channel is annular in shape and surrounds said primary flow channel.

7. The system of claim 1, wherein:

said secondary flow channel is a conduit connected in parallel with said primary flow channel.

8. The system of claim 1, wherein:

said marine propulsion system is a propulsion system of a personal watercraft.

9. The system of claim 2, wherein:

said preventing means is controlled manually by an operator of a marine vessel.

10. The system of claim 1, wherein:

said common flow channel is an eductor, said primary and secondary flow channels both extending between said inlet and said eductor.

11. A marine propulsion system, comprising:

a primary flow channel having an inlet, an impeller region, and a primary discharge;

an impeller disposed for rotation within said primary flow channel between said inlet and said primary discharge;

a secondary flow channel extending from said inlet to a secondary discharge to provide a parallel fluid path to said primary flow channel which allows water to bypass said impeller region under preselected conditions said primary and secondary discharges being disposed within a common flow channel; and a valve associated with said secondary flow channel said valve being configured to prevent fluid flow through said secondary flow channel when said preselected conditions do not exist.

12. The system of claim 10, further comprising:

means for activating and deactivating said valve in response to said preselected conditions.

13. The system of claim 10, wherein:

said preselected conditions comprise a pressure magnitude at a preselected position within said primary channel.

14. The system of claim 10, wherein:

said valve is a shutter which covers a portion of said secondary flow channel.

15. The system of claim 10, wherein:

said secondary flow channel is annular in shape and surrounds said primary flow channel.

16. The system of claim 10, wherein:

said secondary flow channel is a conduit connected in parallel with said primary flow channel.

17. The system of claim 10, wherein:

said common flow channel is an eductor, said primary and secondary flow channels both extending between said inlet and said eductor.

* * * * *